United States Patent [19]

Takeda et al.

[11] 4,062,685

[45] Dec. 13, 1977

[54] NON-SILVER HALIDE LIGHT-SENSITIVE MATERIAL SENSITIZED BY COLLOIDAL ELEMENTS

[75] Inventors: Keiji Takeda; Kenji Matsumoto; Hiroshi Tamura; Masayoshi Nagata, all of Asaka, Japan

[73] Assignee: Fuji Photo Film Co., Ltd., Ashigara, Japan

[21] Appl. No.: 683,876

[22] Filed: May 6, 1976

[30] Foreign Application Priority Data

May 7, 1975 Japan ..... 50-55073

[51] Int. Cl.[2] ..... G03C 1/00

[52] U.S. Cl. ..... 96/88; 96/76 R; 96/48 HD

[58] Field of Search ..... 96/88, 1.5, 48 HD, 76 R

[56] References Cited

U.S. PATENT DOCUMENTS

| | | | |
|---|---|---|---|
| 3,634,336 | 1/1972 | Perez-Albuerne | 96/88 |
| 3,684,509 | 8/1972 | Heuvel et al. | 96/88 |
| 3,707,372 | 12/1972 | Hallman et al. | 96/36.2 |
| 3,819,377 | 6/1974 | Klose et al. | 96/48 R |
| 3,907,566 | 9/1975 | Inoue et al. | 96/88 |

OTHER PUBLICATIONS

Boudreaux, J. Amer. Chem. Soc., vol. 85, No. 14 (1963) pp. 2039–2043.

Boudreaux, J. Amer Chem. Soc., vol. 80 (1957) pp. 1588–1590.

*Primary Examiner*—Won H. Louie, Jr.

*Attorney, Agent, or Firm*—Sughrue, Rothwell, Mion, Zinn and Macpeak

[57] ABSTRACT

An organo-tellurium light-senstive material is described which comprises a support having coated thereon at least one layer comprising an organo-tellurium compound, a sensitizer, a binder, and colloidal particles of an element selected from the group consisting of gold, tellurium, germanium, palladium and platinum. The light-sensitive material has improved sensitivity as compared with one not containing the above colloidal particles.

16 Claims, No Drawings

NON-SILVER HALIDE LIGHT-SENSITIVE MATERIAL SENSITIZED BY COLLOIDAL ELEMENTS

BACKGROUND OF THE INVENTION

1. Field of the Invention

The present invention relates to a light-sensitive material, more particularly, to a light-sensitive material using as an image forming substance an organic tellurium compound and containing colloidal particles of an element selected from the group consisting of gold, tellurium, germanium, palladium and platinum.

2. Description of the Prior Art

Light-sensitive materials have widely been used which comprise, as a light-sensitive substance or an image forming substance, a metal compound capable of giving a visible image consisting of stable metal crystallites by exposure and development.

Representative examples include those employed in photographic processes using silver halides as light-sensitive and image forming substances, details of which are described, for example, in C. E. K. Mees, *The Theory of the Photographic Process,* etc.

There are also known photographic processes utilizing physical development nuclei, in which a metal image is produced by exposing a light-sensitive layer to form development nuclei and then developing the nuclei in a solution containing silver or non-silver ions, as described, for example, in H. Jonker et al., *Photographic Science and Engineering,* 13, pages 1, 38 and 45 (1969); E. J. Delorenzo et al., ibid., 13, page 95 (1969); etc. These photographic processes, however, have disadvantages in that they are generally expensive due to the use of silver and involve complicated liquid processings even in the case where a non-silver metal is employed.

There are also known photographic processes in which no liquid processing is required and development is effected merely by heating. One material so processable is "Dry Silver" (trade name) sold by Minnesota Mining and Manufacturing Company, where silver halides are used as a light-sensitive substance and silver behenates as an image forming substance, and a visible image consisting of silver crystallites is obtained merely by heating after image-wise exposure. Such materials, however, are not free from the disadvantages of high cost and use of valuable resources due to the use of silver. As to details in "Dry Silver," see, for example, U.S. Pat. Nos. 3,152,903, 3,152,904 and 3,475,075.

As another photographic process of the heat developable type, there has recently been proposed a process using as a light-sensitive substance or as an image forming substance elemental organic compounds such as an organo-tellurium compound (e.g., a compound in which a tellurium atom is directly bonded to a carbon atom in an organic group), such as described in Japanese Pat. Application (OPI) No. 29,438/73 and German Offenlegungsshrift No. 2,233,868. The inventors previously proposed in Japanese Pat. application No. 14,330/74 a process using as an organo-tellurium compound a complex produced from a tellurium tetrahalogenide and an organic base. In these processes, no liquid processing is required and a visible image consisting of tellurium crystallites can be obtained by merely heating after image-wise exposure. In addition, they are advantageous because silver is not used.

SUMMARY OF THE INVENTION

The primary object of this invention is to improve the sensitivity of light-sensitive materials using organo-tellurium compounds as an image forming substance.

Other objects of this invention will be apparent from the following description.

It has now been found that the sensitivity of light-sensitive materials of the type described above can be greatly improved by additionally dispersing colloidal particles of an element selected from the group consisting of gold, tellurium, germanium, palladium and platinum into a layer comprising an organo-tellurium compound, a sensitizer and a binder.

DETAILED DESCRIPTION OF THE INVENTION

Organo-tellurium compounds used as an image forming substance in this invention are those belonging to the first to third groups described hereinafter; one or more of them being simultaneously employed in the light-sensitive materials of the invention.

As to compounds of the third group, they can be applied as a coating solution to form a light-sensitive layer by dissolving or dispersing an isolated complex into a solvent together with a sensitizer, a binder and a colloidal element, or by adding a sensitizer, a binder and a colloidal element into a solution of a complex prepared by the reaction of a tellurium tetrahalogenide with an organic base in a solvent.

FIRST GROUP: COMPOUNDS REPRESENTED BY GENERAL FORMULA (1)

$$Y—TeX_2—Y' \quad (1)$$

wherein X represents a chlorine, bromine or iodine atom and the two halogen atoms can be the same or different from each other, Y and Y′ represent groups selected from the following group (A) to group (C) and Y and Y′ can be the same or different from each other.

A. Y, Y′ Belonging to an Ar—CO—$CH_2$— Group

Ar designates a phenyl group, naphthyl group, anthryl group, furyl group, thienyl group, xanthenyl group, benzofuranyl group, benzoquinonyl group or a substituted group thereof. The substituents include an alkyl group (1 to 20 carbon atoms; straight, branched or cyclic); a substituted alkyl group (1 to 20 carbon atoms; straight, branched or cyclic; the substituents include a hydroxyl group, an alkoxy group (preferably containing 1 to 5 carbon atoms), a halogen atom, a cyano group, an acetyl group, a phenyl group, a naphthyl group, a phenoxy group, a phenyl group substituted by a halogen atom, a naphthyl group substituted by a halogen atom, a phenoxy group substituted by a halogen atom, etc.), a halogen atom, a hydroxyl group, an alkoxy group (1 to 20 carbon atoms; straight, branched or cyclic), an alkoxy group substituted by a halogen atom (1 to 20 carbon atoms; straight, branched or cyclic), an acyl group such as an acetyl group (1 to 20 carbon atoms; straight, branched or cyclic), a benzoyl group, a substituted benzoyl group (substituents include an alkyl group containing 1 to 5 carbon atoms, a haloalkyl group which is a halogen (such as F, Cl, Br, I) substituted alkyl group having 1 to 5 carbon atoms, a halogen atom, etc.), a nitro group, a cyano group, a phenyl group, a phenoxy group, a substituted phenyl or phenoxy group (such substituents include an alkyl group having 1 to 10 carbon atoms, a haloalkyl group which is a halogen (such as F, Cl, Br, I) substituted alkyl group having 1 to 5 carbon atoms, and an alkoxy group having 1 to 10 carbon atoms, etc.), an alkenyl group (containing 1 to 20 carbon atoms, e.g., a vinyl group, allyl group, methylvinyl group, butenyl group, etc.) and a substituted alkenyl group (which is alkenyl group as described above substituted by a halogen atom, a hydroxy group, an alkoxy group containing 1 to 5 carbon atoms, a cyano group, an acetyl group, a phenyl group, a substituted phenyl group (substituents include an alkyl group having 1 to 5 carbon atoms, a hydroxy group, an alkoxy group having 1 to 5 carbon atoms, halogen atoms, etc.), etc.), a furyl group, a xanthenyl group, etc.

Specific examples of organic tellurium compounds having these groups are shown in the following using chemical formulae or constitutional formulae: $(C_6H_5COCH_2)_2TeCl_2$, $(C_{10}H_7COCH_2)_2TeCl_2$, $(C_{14}H_9COCH_2)_2TeCl_2$,

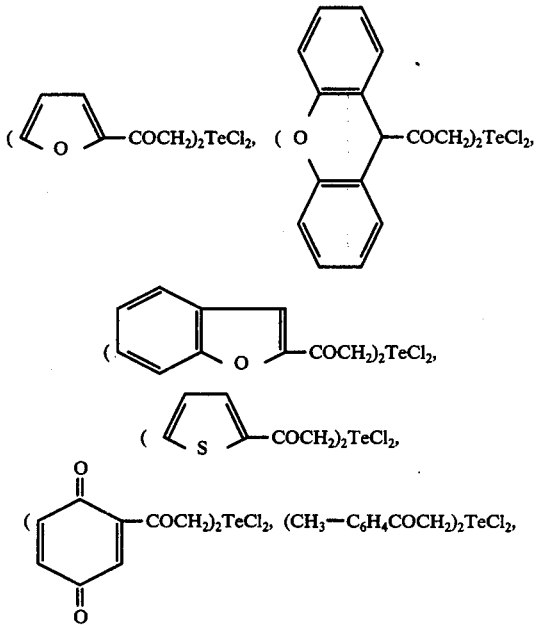

$(C_2H_5C_6H_4COCH_2)_2TeCl_2$, $(t—C_4H_9—C_6H_4COCH_2)_2TeCl_2$,
$(n—C_{18}H_{37}C_6H_4COCH_2)_2TeCl_2$, $(ClCH_2—C_6H_4COCH_2)_2TeCl_2$,
$(C_6H_5CH_2—C_6H_4—COCH_2)_2TeCl_2$, $(C_6H_5OCH_2CH_2—C_6H_4COCH_2)_2TeCl_2$,
$(ClC_6H_4COCH_2)_2TeCl_2$, $(BrC_6H_4COCH_2)_2TeCl_2$,
$(HO—C_6H_4COCH_2)_2TeCl_2$, $(CH_3O—C_6H_4COCH_2)_2TeCl_2$,
$(ClCH_2CH_2O—C_6H_4COCH_2)_2TeCl_2$, $(CH_3COC_6H_4COCH_2)_2TeCl_2$,
$(C_6H_5COC_6H_4COCH_2)_2TeCl_2$, $(O_2N—C_6H_4COCH_2)_2TeCl_2$,
$(NC—C_6H_4COCH_2)_2TeCl_2$, $(C_6H_5—C_6H_4COCH_2)_2TeCl_2$,
$(C_6H_5O—C_6H_4COCH_2)_2TeCl_2$, $(CH_2=CH—C_6H_4COCH_2)_2TeCl_2$,
$(C_6H_5CH=CH—C_6H_4COCH_2)_2TeCl_2$, $(CH_2=CH—CH_2—C_6H_4COCH_2)_2TeCl_2$,
$(CH_3CH=CH—C_6H_4COCH_2)_2TeCl_2$, $(t—C_4H_9—C_{10}H_6COCH_2)_2TeCl_2$,

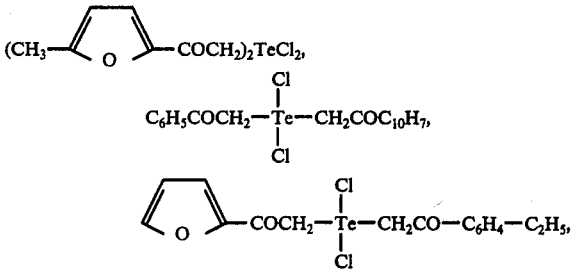

and compounds obtained by substituting one or more chlorine atoms bonded to the tellurium atom of the above described compounds by a bromine or iodine atom, etc.

B. Y, Y′ belonging to an R—$COCH_2$—group

R designates an alkyl group (1 to 20 carbon atoms; straight, branched or cyclic); an alkenyl group (1 to 20 carbon atoms; straight, branched or cyclic) and a substituted group thereof. Substituents include a halogen atom; a hydroxyl group; an alkoxy group (1 to 10 carbon atoms; straight, branched or cyclic); an alkoxy group substituted with a halogen atom (1 to 10 carbon atoms; straight, branched or cyclic); an acyl group, preferably having 1 to 15 carbon atoms, such as an acetyl group; a cyano group; an aromatic ring containing groups such as a phenyl group, naphthyl group, anthryl group, phenoxy group and benzoyl group, etc.; a substituted group of these aromatic rings (substituents include an alkyl group containing 1 to 10 carbon atoms and such an alkyl group substituted with a halogen atom or with an alkoxy group, preferably having 1 to 5 carbon atoms; a halogen atom; hydroxyl group; an alkoxy group containing 1 to 10 carbon atoms; an alkoxy group, preferably having 1 to 10 carbon atoms, substituted with a halogen atom; an acyl group, preferably having 1 to 5 carbon atoms such as an acetyl group; a benzoyl group; a phenyl group; a phenoxy group and a substituted benzoyl, phenyl or phenoxy group wherein substituents include an alkyl group having 1 to 10 carbon atoms, a haloalkyl group having 1 to 10 carbon atoms, a halogen atom, etc.

Further, an organic tellurium compound in which the R part of two R—$COCH_2$— groups are connected to the tellurium such as

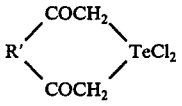

can be used in the present invention. Here, R′ designates an alkyl group having 1 to 3 carbon atoms, an alkenyl group having 2 to 4 carbon atoms, an alkyl group ($C_1$–$C_{10}$) which is substituted with a phenyl group, a halogen atom, etc.

Specific examples of tellurium compounds having these groups (R or R′) are shown in the following using chemical formulae or constitutional formulae:
$(CH_3COCH_2)_2TeCl_2$, $(C_2H_5COCH_2)_2TeCl_2$, $(t—C_4H_9COCH_2)_2TeCl_2$,
$(n—C_{11}H_{23}COCH_2)_2TeCl_2$, $(CH_2=CH—CH_2COCH_2)_2TeCl_2$,
$(CH_3CH=CHCH_2COCH_2)_2TeCl_2$, $(C_6H_{11}COCH_2)_2TeCl_2$, $(ClCH_2COCH_2)_2TeCl_2$, $[Br(CH_2)_4COCH_2]_2TeCl_2$, $(HOCH_2CH_2COCH_2)_2TeCl_2$,
$(CH_3OCH_2CH_2COCH_2)_2TeCl_2$, $(CH_3COCH_2COCH_2)_2TeCl_2$,
$(CF_3COCH_2COCH_2)_2TeCl_2$, $(C_6H_5COCH_2COCH_2)_2TeCl_2$,
$(C_6H_5CH_2COCH_2)_2TeCl_2$, $(CH_3C_6H_4CH_2COCH_2)_2TeCl_2$,
$(ClC_6H_5CH_2CH_2COCH_2)_2TeCl_2$, $(ClCH{=}CHCOCH_2)_2TeCl_2$,
$(C_6H_5{-}CH{=}CHCH_2COCH_2)_2TeCl_2$,

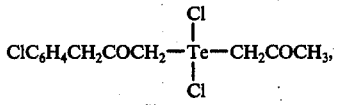

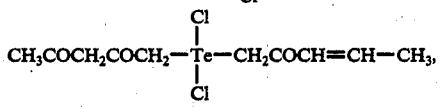

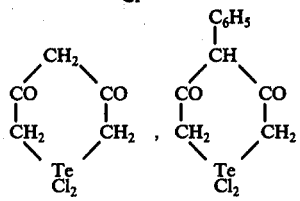

and compounds obtained by substituting one or more of the chlorine atoms bonded to the tellurium atom of the above described compounds by a bromine or iodine atom, etc.

C. Y, Y' Belonging to Ar in (A) or R in (B):

Specific examples of the organic tellurium compounds having these groups are shown in the following using chemical formulae or constitutional formulae:

$(C_6H_5)_2TeCl_2$, $(C_{10}H_7)_2TeCl_2$,

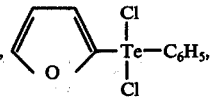

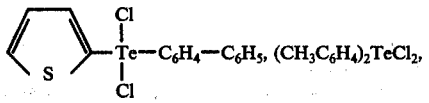

$(NC{-}C_6H_4)_2TeCl_2$, $(n\text{-}C_5H_{11})_2TeCl_2$, $(n\text{-}C_{18}H_{37})_2TeCl_2$,

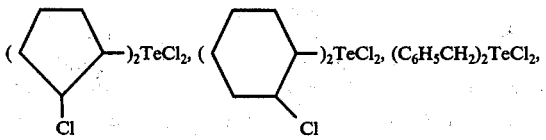

$(O_2N{-}C_6H_4CH_2)_2TeCl_2$, $CH_3O{-}C_6H_4{-}$

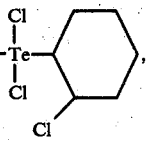

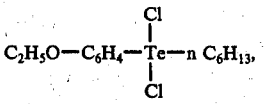

-continued

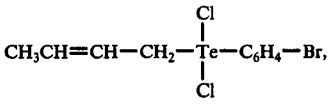

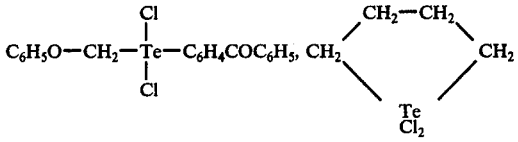

and compounds obtained by substituting one or more chlorine atoms bonded to the tellurium atom of the above described compounds by a bromine or iodine atom, etc.

Second Group: Compounds represented by general formula (2)

$$Z{-}TeX_3 \qquad (2)$$

wherein X designates a chlorine, bromine or iodine atom, and the three halogen atoms can be the same or different from each other, and Z designates a group belonging to Y, Y' of general formula (1) as described in the First Group.

Specific examples of organic tellurium compounds belonging to this group are shown in the following using chemical formulae or constitutional formulae:

$C_6H_5COCH_2{-}TeCl_3$, $CH_3C_6H_4COCH_2{-}TeCl_3$, $CH_3O{-}C_6H_4COCH_2{-}TeCl_3$,
$Cl{-}C_6H_4COCH_2{-}TeCl_3$, $HO{-}C_6H_4COCH_2{-}TeCl_3$, $O_2N{-}C_6H_4COCH_2{-}TeCl_3$, $NC{-}C_6H_4COCH_2{-}TeCl_3$, $CH_2{=}CH{-}C_6H_4{-}COCH_2{-}TeCl_3$, $CH_3CO{-}C_6H_4COCH_2{-}TeCl_3$, $C_{10}H_7COCH_2{-}TeCl_3$, $C_{14}H_9COCH_2{-}TeCl_3$,

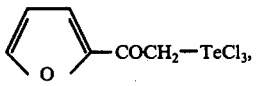

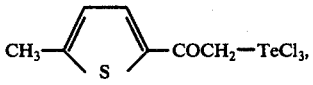

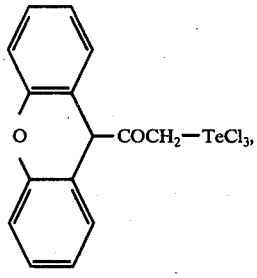

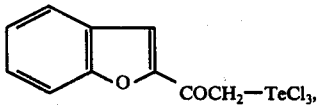

-continued

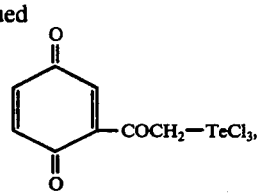

$n—C_6H_{13}—COCH_2—TeCl_3$, $n—C_{18}H_{37}—COCH_2—TeCl_3$, $CH_3COCH_2—TeCl_3$, $t—C_4H_9COCH_2—TeCl_3$, $C_6H_5—CH=CH—CH_2—COCH_2—TeCl_3$, $C_6H_5TeCl_3$, $C_{10}H_7TeCl_3$,

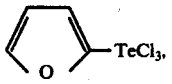

$NC—C_6H_4TeCl_3$, $n—C_4H_9—C_6H_4—TeCl_3$, $C_2H_5O—C_6H_4—TeCl_3$, $C_6H_5COC_6H_4—TeCl_3$, $n—C_6H_{13}—TeCl_3$,

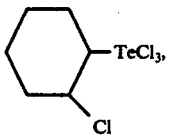

$n—C_{11}H_{23}—TeCl_3$, $C_2H_5OCH_2CH_2—TeCl_3$, $C_6H_5CH_2—TeCl_3$, $CH_3—C_6H_4—CH_2CH_2—TeCl_3$, $C_6H_5OC_6H_4—TeCl_3$, $C_6H_5—C_6H_4Tecl_3$, and compounds obtained by substituting one or more chlorine atoms bonded to the tellurium atom of the above described compounds by a bromine or iodine atom, etc.

The organic tellurium compounds listed in the First Group and the Second Group are only a part of the compounds useful as image forming components in the present invention, and many other compounds may be used. For example, descriptions on examples of organic tellurium compounds and methods for the production thereof can be found in Kurt Irgolic & Ralph Zingaro, "Reactions of Organotellurium Compounds" in *Organometallic Reactions,* Vol. 2, Wiley-Interscience (1971), etc.

Third Group: Complexes formed by tellurium tetrachloride and an organic base, and represented by general formula (3)

$$Dn \cdot TeX_4 \quad (3)$$

wherein X represents a chlorine, bromine or iodine atom and the four halogen atoms can be the same or can be two or three different kinds of halogen atoms, D designates an organic base described in the following and *n* designates an integer of 1 to 6; compounds where $n = 2$ are particularly important. The organic base includes an aliphatic amine compound, an aralkylamine compound, an aromatic amine compound, a nitrogen atom containing heterocyclic compound, etc.

Most preferred of the above compounds are aliphatic amines having 1 to 25 carbon atoms, aralkyl amines having 7 to 35 carbon atoms wherein the arly moiety is phenyl, naphthyl or anthryl, aromatic amines having 6 to 35 carbon atoms wherein the aromatic ring is phenyl, naphthyl or athryl and N-containing heterocyclic compounds having 5 or 6 members, such as compounds having a pyridine ring, pyridazine ring, pyrimidine ring, pyrazine ring, 1,3,5-triazine ring, pyrrole ring, quinoline ring, indole ring, carbazole ring, an aryl (phenyl or naphthyl) diazonium salt, etc., or derivatives thereof.

Specific examples of the organic base are those represented by the following general formulae (I) through (XII).

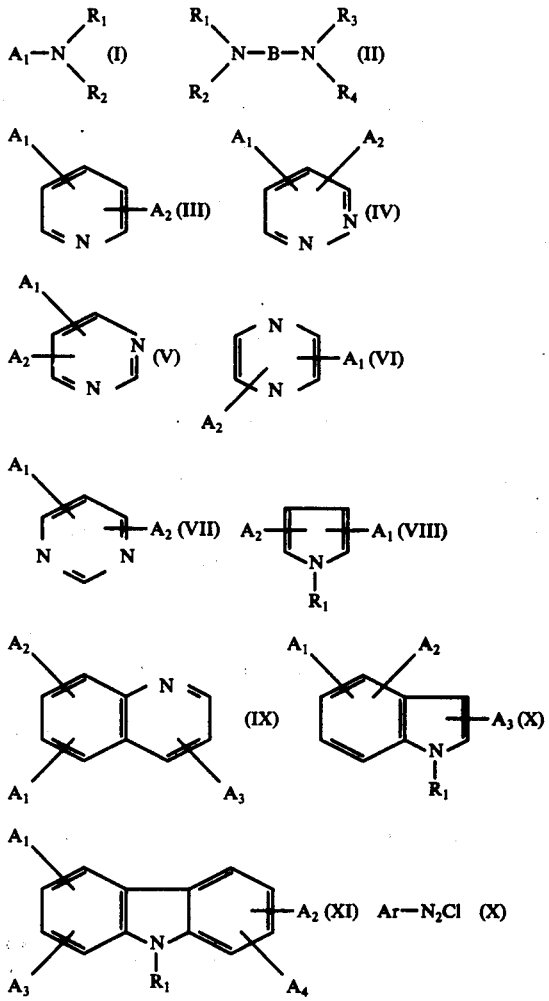

wherein $A_1$, $A_2$, $A_3$ and $A_4$ represent a hydrogen atom, an alkyl group (straight, branched or cyclic; which includes substituted ones), or an aryl group (which also includes substituted ones). Alkyl groups shown by $A_1$, $A_2$, $A_3$ and $A_4$ having 1 to 25 carbon atoms are especially useful; substituents include, for example, an alkoxy group having 1 to 5 carbon atoms, an aryl group such as phenyl, naphthyl, anthryl, etc., an aryloxy group such as phenoxy, naphthoxy, anthryloxy, etc., an aminoalkyl group where the alkyl moiety has 1 to 5 carbon atoms, an aminoaryl group where the aryl moiety is the same as the above defined aryl group, a sulfoalkyl group where the alkyl moiety has 1 to 5 carbon atoms, a sulfoaryl group where the aryl moiety is the same as above defined, a halogen atom, a halogenoaryl group wherein the aryl moiety includes phenyl, naphthyl or anthryl, etc. The aryl groups shown by $A_1$, $A_2$, $A_3$ and $A_4$ include a phenyl group, naphthyl group, anthryl group, phenanthryl group; substituents include an alkyl group having 1 to 20 carbon atoms, an aryl group the same as the above defined aryl group, an alkoxy group having 1 to 20 carbon atoms, an aryloxy group wherein the aryl moiety is the same as above defined, an acetyl group, a sulfoalkyl group where the alkyl moiety has 1 to 20 carbon atoms, a sulfoaryl group where the aryl moiety is as above defined, a sulfoaryl group where the aryl moiety is as above defined, a halogenoalkyl group where the alkyl moiety has 1 to 20 carbon atoms, a halogenoaryl group where the aryl moiety is as above defined and an aralkyl group which is a phenyl, naphthyl or athryl group substituted with an alkyl group having 1 to 20 carbon atoms, etc.

Specific examples of groups shown by $A_1$, $A_2$, $A_3$ and $A_4$ include a methyl group, ethyl group, propyl group, isopropyl group, cyclopropyl group, butyl group, sec-butyl group, tert-butyl group, pentyl group, isopentyl group, neopentyl group, tert-pentyl group, hexyl group, isohexyl group, tert-hexyl group, cyclohexyl group, heptyl group, isoheptyl group, tert-heptyl group, methylcyclohexyl group, octyl group, isoctyl group, tert-octyl group, dimethylcyclohexyl group, nonyl group, tert-nonyl group, decyl group, tert-decyl group, undecyl group, tert-undecyl group, dodecyl group, tert-dodecyl group, tridecyl group, tert-tridecyl group, tetradecyl group, tert-tetradecyl group, pentadecyl group, sec-pentadecyl group, tert-pentadecyl group, hexadecyl group, tert-hexadecyl group, octadecyl group, sec-octadecyl group, tert-octadecyl group, nonadecyl group, sec-nonadecyl group, tert-nonadecyl group, eicosyl group, sec-eicosyl group, tert-eicosyl group, heneicosyl group, sec-heneicosyl group, tert-heneicosyl group, docosyl group, sec-docosyl group, tert-docosyl group, tricosyl group, sec-tricosyl group, tert-tricosyl group, tetracosyl group, sec-tetracosyl group, tert-tetracosyl group, pentacosyl group, sec-pentacosyl group, tert-pentacosyl group, ethoxyethyl group, ethoxypropyl group, ethoxybutyl group, ethoxypentyl group, ethoxyhexyl group, methoxyhexyl group, methoxyheptyl group, ethoxyheptyl group, methoxyoctyl group, ethoxyoctyl group, benzyl group, triphenylmethyl group, phenyl group, naphthyl group, tolyl group, xylyl group, mesityl group, hydroxyphenyl group, dihydroxyphenyl group, acetylphenyl group, benzophenonyl group, methoxyphenyl group, ethoxyphenyl group, nitrophenyl group, dinitrophenyl group, chlorophenyl group, bromophenyl group, trifluoromethylphenyl group, biphenylyl group, phenoxyphenyl group, vinylphenyl group, sulfophenyl group, acetonaphthyl group, chloronaphthyl group, dichloronaphthyl group, hydroxynaphthyl group, methylnaphthyl group, methoxynaphthyl group, ethoxynaphthyl group, anthryl group, acetoanthryl group, chloroanthryl group, hydroxyanthryl group, dihydroxyanthryl group, methoxynaphthyl group, phenanthryl group, acetylphenanthryl group, methoxyphenanthryl group, dimethoxyphenanthryl group, and sulfophenanthryl group, etc.

Of the substituents for $A_1$, $A_2$, $A_3$ and $A_4$, particularly useful are hydrogen atoms; alkyl groups with 2 to 25 carbon atoms unsubstituted or substituted with an alkoxy group with 1 to 2 carbon atoms or a phenyl group; phenyl groups unsubstituted or substituted with an alkyl group with 1 to 2 carbon atoms, an alkoxy group with 1 to 2 carbon atoms, acetyl, trifluoromethyl, nitro, hydroxyl, acetophenonyl, phenoxy or phenyl groups or halogen atoms; naphthyl groups; anthryl groups; and phenanthryl groups.

In general formula (II), B designates a group which is divalent, e.g., an aliphatic hydrocarbon group, preferably an alkylene group, which may be straight or branched, and includes a substituted group, and further includes a substituted or unsubstituted phenylene group or a double bond inserted in the straight chain, or an arylene group (which includes a substituted one). Useful aliphatic hydrocarbons having divalency shown by B are those having 1 to 10 carbon atoms; substituents include an alkoxy group having 1 to 5 carbon atoms, an aryl group such as a phenyl, naphthyl or anthryl group, an aryloxy group wherein the aryl moiety is as defined for the above aryl group, a nitro group, an amino group, an aminoaryl group wherein the aryl moiety is as defined for the above aryl group, an acetyl group and a halogen atom, etc., the groups to be inserted include a phenylene group, a substituted phenylene group, a naphthylene group, a substituted naphthylene group, a biphenylene group, a substituted biphenylene groups, a carbonyldiarylene group, and a thiocarbonyldiarylene group, etc. Useful arylene groups shown by B include a phenylene, naphthylene, anthrylene and phenanthrylene group, and substituents include an alkyl group having 1 to 10 carbon atoms, an aryl group having 1 to 10 carbon atoms, an alkoxy group having 1 to 10 carbon atoms an aryloxy group wherein the aryl moiety is as above defined for the aryl moiety shown by B, a nitro group, an amino group, an aminoaryl group wherein the aryl moiety is as above defined for the aryl moiety shown by B, an aralkyl group which is phenyl, naphthyl or anthryl substituted with an alkyl group having 1 to 20 carbon atoms, a halogen atom, an acetyl group, an acetylaryl group where the aryl moiety is a moiety such as phenyl, naphthyl, or anthryl, and a hydroxyl group, etc.

Specific examples of the groups shown by B include an ethylene group, propylene group, butylene group, pentamethylene group, heptamethylene group, octamethylene group, nonamethylene group, decamethylene group, ethylethylene group, dimethylpropylene group, methylbutylene group, dimethylbutylene group, ethylbutylene group, methylpentamethylene group, dimethylpentamethylene group, ethylpentamethylene group, diethylhexamethylene group, phenylpropylene group, chlorophenylpropylene group, hydroxypentamethylene group, hydroxyheptamethylene groups, methoxy heptamethylene group, methoxyoctamethylene group, ethoxynonamethylene group, ethoxydecamethylene group, chloropentamethylene group, chlorooctamethylene group, benzylbutylene group, benzylpropylene group, tolylpentamethylene group, xylylbutylene group, xylylheptamethylene group, 4,4'-methylenediphenylene group, 4,4'-phenylmethylenediphenylene group, 4,4'-carbonyldiphenylene group, 4,4'-aminophenylmethylenediphenylene group, oxydiphenylene group, propenylene group, butenylene group, pentenylene group, heptenylene group, octenylene group, nonanylene group, decadienylene group, nonadienylene group, octadienylene group, heptadienylene group, phenylene group, chlorophenylene group, aminophenylene group, nitrophenylene group, methoxyphenylene group, phenylphenylene group, phenoxyphenylene group, aminophenylphenylene group, styrylphenylene group, acetylphenylene group, acetylphenylphenylene group, aminophenacylphenylene group, bromophenylene group, oxyphenylphenylene group, biphenylene group, methylbiphenylene group, dimethylbiphenylene group, hydroxybiphenylene group, naphthylene group, acetonaphthylene group, methylnaphthylene group, dimethylnaphthylene group, hydroxynaphthylene group, phenanthrylene group, acetylphenanthrylene group, methylphenanthrylene group and methoxyphenanthrylene group, etc.

Particularly useful groups among those shown by B are unsubstituted alkylene groups having 2 to 6 carbon atoms; 2 to 6 carbon atom containing alkylene group substituted with a 1 to 2 carbon atom containing alkoxy group, a phenyl group, an aminophenyl group, a halogen atom, a 1 to 2 carbon atom containing alkyl group or a hydroxyl group; a 2 to 6 carbon atom containing alkylene group inserted with a 2 to 6 carbon atom containing monoene, diene, triene or arylene group, i.e., $-(CH_2)_n-Y-(CH_2)_m-$, wherein $n + m = 2 - 6$, $Y$ representing monoene, diene, triene or arylene, a 4,4'-methylenediphenylene group, a 4,4'-carbonyldiphenylene group, an oxydiphenylene group, or a diphenylene group; a phenylene group; a phenylene group substituted with a 1 to 2 carbon atom containing alkyl group, a 1 to 2 carbon atom containing alkoxy group, an acetyl group, a halogen atom, a trifluoromethyl group, a nitro group, a hydroxyl group, an acetophenonyl group, a phenoxy group, an amino group, an aminophenyl group, a nitrophenyl group, a halogenophenyl group, a hydroxyphenyl group or a phenyl group; a naphthylene group; an anthrylene group; and a phenanthrylene group.

In general formula (XII), Ar designates an aryl group. The aryl group can be unsubstituted or substituted with an alkyl group having 1 to 10 carbon atoms, a hydroxyl group, an alkoxy group having 1 to 10 carbon atoms, an aryloxy group such as phenoxy, naphthoxy or anthryloxy, an aminoalkyl group where the alkyl moiety has 1 to 5 carbon atoms, such as phenylamino, naphthylamino or anthrylamino, a cyano group, a nitro group, a carboxyl group, a sulfo group, or a halogen atom. The aryl group includes a phenyl group, naphthyl group, anthryl group and phenanthryl group.

In the formula, $R_1$, $R_2$, $R_3$, and $R_4$ may be the same or different from each other, and each represents a hydrogen atom, an alkyl group or an aryl group. The alkyl group may be straight, branched or cyclic. Useful alkyl groups are those containing 1 to 6 carbon atoms and useful aryl groups are a phenyl group and a naphthyl group. The alkyl group (which may be substituted with one or more halogen atoms) and aryl group may further be substituted with an aminoalkyl group wherein the alkyl moiety has 1 to 10 carbon atoms, an aminoaryl group such as an aminophenyl or aminonaphthyl group, an alkoxy group having 1 to 10 carbon atoms or a halogen atom. The aryl group may further be substituted with an alkyl group having 1 to 10 carbon atoms. The groups shown by $R_1$, $R_2$, $R_3$, and $R_4$ caz include, for example, a methyl group, ethyl group, propyl group, butyl group, hexyl group, octyl group, pentyl group, cyclopentyl group, cyclohexyl group, chloroethyl group, phenyl group, styryl group, p-methoxyphenyl group, p-chlorophenyl group, p-nitrophenyl group, naphthyl group, p-aminophenyl group, aminonaphthyl group, tolyl group, and a hydrogen atom. Particularly useful groups shown by $R_1$, $R_2$, $R_3$ and $R_4$ are 1 to 2 carbon atom containing alkyl groups unsubstituted or substituted with a chlorine atom or a phenyl group; a phenyl group unsubstituted or substituted with an alkoxy group having 1 to 10 carbon atoms, a nitro group or an amino group; and a hydrogen atom.

Substituents $A_1$, $A_2$, $A_3$, $A_4$, Ar, B, $R_1$, $R_2$, $R_3$ and $R_4$ in the compounds shown by general formulae (I) through (XII) are not limited to those described above, and any substituent can be included so long as the compound will form a complex with a tellurium halide.

Specific examples of the compounds are ethylamine, propylamine, butylamine, tert-butylamine, pentylamine, isopentylamine, hexylamine, heptylamine, octylamine, nonylamine, decylamine, tert-decylamine, undecylamine, dodecylamine, tetradecylamine, pentadecylamine, octadecylamine, nonadecylamine, eicosylamine, docosylamine, tricosylamine, tetracosylamine, pentacosylamine, ethoxyethylamine, ethoxypropylamine, ethoxybutylamine, ethoxypentylamine, ethoxyhexylamine, methoxyhexylamine, methoxyoctylamine, methoxyeicosylamine, methoxytricosylamine, benzylamine, tritylamine, phenethylamine, vanillylamine, veratrylamine, poly(p-aminostyrene), N-methylethylamine, N-methylpropylamine, N-methylbutylamine, N-methyl-tert-butylamine, N-methylheptylamine, N-methyloctylamine, N-methylnonylamine, N-methyl-tert-decylamine, N-methyloctadecylamine, N-methyldecylamine, N-methylethoxybutylamine, N-methylmethoxyhexylamine, N-methylmethoxyeicosylamine, N-methylbenzylamine, N-methyltrimethylamine, N-methylphenethylamine, N-methylvanillylamine, N-methylveratrylamine, N-ethylbutylamine, N-ethylpentylamine, N-ethyldecylamine, N-ethyldodecylamine, N-ethyloctadecylamine, N-ethyleicosylamine, N-ethyldocosylamine, N-ethyltetracosylamine, N-ethylpentacosylamine, N-ethylethoxyhexylamine, N-ethylmethoxyhexylamine, N-ethylbenzylamine, N,N-dimethylethylamine, N,N-dimethylpropylamine, N,N-dimethylbutylamine, N,N-dimethyl-tert-butylamine, N,N-dimethylheptylamine, N,N-dimethyloctylamine, N,N-dimethylnonylamine, N,N-dimethylmethoxyhexylamine, N,N-dimethylmethoxyeicosylamine, N,N-dimethylphenethylamine, N,N-dimethylvanillylamine, N,N-dimethylveratrylamine, N,N-diethylvanillylamine, N,N-diethylpropylamine, N,N-diethylbenzylamine, N,N-dimethylbenzylamine, aniline, nitroaniline, trifluoromethylaniline, toluidine, ethylaniline, chloroaniline, bromoaniline, methyl aminobenzoate, butylaniline, phenylaniline, naphthylaniline, dinitroaniline, naphthylamine, methoxyaniline, acetylaniline, N-methylaniline, N-ethylaniline, N,N-dimethylaniline, N,N-diethylaniline, N-methylnitroaniline, N,N-dimethylnitroaniline, N,N-diethylnitroaniline, N,N-dimethyltoluidine, N,N-dimethylacetylaniline, N,N-dimethylmethoxyaniline, N,N-dimethylnaphthylamine, N,N-dimethyltrifluoroaniline, p-n-dodecylaniline, ethylenediamine, propylenediamine, butylenediamine, ethylethylenediamine, methyltrimethylenediamine, propenylenediamine, hexadienylenediamine, phenyltrimethylenediamine, diaminodiphenylmethane, diaminobenzophenone, naphthylenediamine, benzidine, oxydiphenylenediamine, phenylenediamine, methylphenylenediamine, ethylphenylenediamine, N,N,N',N'-tetramethylphenylenediamine, N,N,N',N'-tetramethyl-oxydiphenylenediamine, N,N,N',N'-tetramethyl-4,4'-methylenedianiline, N,N,N',N'-tetramethyldiaminobenzophenone, N,N,N',N'-tetramethylbenzidine, N,N,N',N'-tetramethylethylenediamine, N,N,N',N'-tetramethylhexamethylenediamine, N,N,N',N'-tetramethylpropanediamine, N,N,N',N'-tetramethyltrimethylenediamine, diaminopyridine, methylpyridine, dimethylpyridine, pyridine methanol, pyridine ethanol, pyridine carboxylic acid methyl ester, pyrazine, methyl-pyrazine, ethylpyrazine, pyrazine dicarboxylic acid methyl ester, trimethylpyrazine, pyrimidine, 5-methylpyrimidine, methoxypyrimidine, 5-hydroxypyrimidine, methylpyridazine, methoxypyridazine, phenylpyridazine, ethylpyridazine, triazine, pyrrole, N-methylpyrrole, acetylpyrrole, dinitropyrrole, tetramethylpyrrole, dipyrilmethane, N-methylacetylpyrrole, indole, β-aminoethylindole, methylindole, methoxyindole, N-methylindole, N-methylmethylindole, dimethylindole, carbazole, N-methylcarbazole, N-ethylcarbazole, N-methylacetylcarbazole, N-methyldiacetylcarbazole, N-methylnitrocarbazole, N-propylcarbazole, aminocarbazole, quinoline, quinolinemethanol, chloroquinoline, methoxyquinoline, nitroquinoline, aminoquinoline, benzenediazoniumchloride, p-nitrobenzenediazoniumchloride, methylbenzenediazoniumchloride, chlorobenzenediazoniumchloride, cyanobenzenediazoniumchloride, acetylbenzenediazoniumchloride, and p-N,N-dimethylaminobenzenediazoniumchloride, etc. One or more of these organic bases can be used as the occasion demands.

To synthesize the complex used in the present invention the procedures described by A. Lowy & P. F. Dunbrook, *Journal of the American Chemical Society,* Vol. 44, p. 614 (1922); S. Prasad & B. L. Khandelwal, *Journal of the Indian Chemical Society,* Vol. 38, p. 837 (1961); R. Korewa, *Roczniki Chemistry,* Vol. 37, p. 1565 (1963); and E. A. Boudreaux, *Journal of the American Chemical Society,* Vol. 85, p. 2039 (1963); etc., can be used.

In the following, examples of synthesis of representative compounds are given.

SYNTHESIS EXAMPLE 1

A complex of ethylenediamine and tellurium tetrachloride: $C_2H_4(NH_2)_2 \cdot TeCl_4$ 6.75 g (0.025 mol) of tellurium tetrachloride and 50 ml of chloroform were put into a flask having a volume of 200 ml equipped with a stirring means and a dropping means, then a solution of 1.65 g (0.0275 mol) of ethylene diamine and 50 ml of chloroform was dropped therein while stirring. After dropping, the solution was further stirred at room temperature (about 25° C) for one hour, and a precipitate obtained was separated by filtration. The precipitate was then rinsed with chloroform until the filtrate did not form a complex with chloroform, and then dried. 7.8 g (yield 94%, light yellow powder, decomposed at a temperature not less than 150° C) of product was obtained.

SYNTHESIS EXAMPLE 2

A complex of p-nitrobenzenediazoniumchloride and tellurium hexachloride: $(O_2NC_6H_4N_2)_2 \cdot TeCl_6$ A saturated ethyl alcohol solution of p-nitrobenzenediazoniumchloride obtained from p-nitroaniline in absolute alcohol according to the method by Koenings (Ann., Vol. 509, p. 149 (1934)) was added to a saturated ethyl alcohol solution of tellurium tetrachloride in an amount such that the molar ratio of the diazonium salt to tellurium tetrachloride was 2, and then stirred at room temperature (about 25° C) for about one hour. The precipitate obtained was separated by filtration. The precipitate was then rinsed with ether, and then dried at low pressure to obtain the complex $(O_2NC_6H_4N)_2 \cdot TeCl_6$ having a melting point of 121° C in a qualitative yield. The process was carried out in the dark.

A simple test exists which enables one skilled in the art to determine most preferred organo-tellurium compounds. In general, a mixture of the organo-tellurium compound and a reducing agent (for example, 4-methoxy-1-naphthol) is heated to a temperature of 110° to 150° C, and if the mixture becomes dark, the organo-tellurium compound is useful. The most suitable method of determining optimum organo-tellurium compounds is, of course, to actually form a light-sensistive material and to determine if the results using any particular combination are acceptable (empirical determination).

The amount of organo-tellurium compound(s) used in the light-sensitive materials of this invention is preferably from about 1 g/m² to about 0.01 g/m², more preferably from 5 g/m² to 0.05 g/m², expressed as the amount of elemental tellurium.

The sensitizers used in this invention are those capable of enhancing the sensitivity of the image forming substance, i.e., the organo-tellurium compounds, or capable of undergoing a photochemical reaction to produce a product capable of reacting with the organo-tellurium compounds to promote the formation of images. Particularly important sensitizers are those capable of undergoing a photochemical reduction to produce a reductant capable of reducing the organo-tellurium compounds to liberate elemental tellurium during the stage of exposure or thermal development after exposure.

As examples of such sensitizers, mention may be made of quinone compounds, ketone compounds, photoreductive dyes and photoreductive metal salts.

The quinone compounds include unsubstituted or substituted 9,10-phenanthraquinones, unsubstituted or substituted acenaphthenequinones, unsubstituted or substituted 9,10-anthraquinones, wherein for the above quinones, the substituents are one or more alkyl groups having 1 to 10 carbon atoms, aryl groups (such as phenyl or naphthyl), halogen atoms (such as Cl or Br), nitro groups, sulfo groups, etc.; wherein such quinones may be fused to 1 to 10 benzene rings; unsubstituted or substituted α-naphthoquinones, unsubstituted or substituted p-benzoquinones, wherein of these quinones, the substituents are one or more alkyl groups having 1 to 10 carbon atoms, aryl groups (such as phenyl or naphthyl), halogen atoms (such as Cl, Br), nitro groups, sulfo groups, etc.

Specific examples of such quinone sensitizers are 9,10-phenanthraquinone, acenaphthenequinone, 9,10-anthraquinone, α-naphthoquinone, p-benzoquinone, 2-methyl-9,10-phenanthraquinone, 3-chloroacenaphthequinone, 2-chloroanthraquinone, 2-nitroanthraquinone, 2-tert-butylanthraquinone, 2-methylanthraquinone, benzanthraquinone, duroquinone, and the like.

The ketone compounds include ketone compounds represented by the following formula:

$$Ar-\overset{\overset{\displaystyle O}{\|}}{C}-R$$

wherein Ar is an aryl group having 1 to 3 fused aromatic rings which may be substituted with one or more alkyl groups having 1 to 5 carbon atoms, amino groups (i.e., $-NH_2$), halogen atoms (such as Cl, Br), nitro groups, sulfo groups, acyl groups having 2 to 10 carbon atoms (such as an acetyl group, etc.), or amino groups substituted with one or two alkyl groups having 1 to 5 carbon atoms; and wherein R is an alkyl group having 1 to 10 carbon atoms which may be substituted by one or more halogen atoms, phenyl groups, naphthyl groups, benzoyl groups, etc.; an aryl group having 1 to 3 fused aromatic rings which may be substituted with one or more alkyl groups having 1 to 5 carbon atoms, amino groups (i.e., $—NH_2$), amino groups substituted with one or two alkyl groups having 1 to 5 carbon atoms, acyl groups having 2 to 10 carbon atoms, halogen atoms (such as Cl, Br), nitro groups, sulfo groups, acyl groups having 2 to 5 carbon atoms, etc.; a benzoyl group which may be substituted with one or more alkyl groups having 1 to 5 carbon atoms, amino groups (i.e., $—NH_2$), amino groups substituted with one or two alkyl groups having 1 to 5 carbon atoms, acyl groups having 2 to 10 carbon atoms, halogen atoms (such as Cl, Br), nitro groups, sulfo groups, acyl groups having 2 to 5 carbon atoms, etc.; fluorenone or anthrone which may be substituted with one or more alkyl groups having 1 to 5 carbon atoms, halogen atoms (such as Cl, Br), nitro groups, amino groups (i.e., $—NH_2$), etc.

Specific examples of ketone sensitizers are benzophenone, phenyl naphthyl ketone, acetophenone, $\alpha$ or $\beta$-acetonaphthone, dibenzoyl, fluorenone, anthrone, p-acetylbenzophenone, Michler's ketone, 3-nitrobenzophenone, p-diacetylbenzene, $\omega$-tribromoacetone, dibenzoylmethane, and the like.

These quinones and ketones, which are useful as sensitizers in this invention, are widely employed as photopolymerization initiators, as described, for example, in U.S. Pat. Nos. 2,367,660, 2,413,973, 2,993,789, 2,951,758 and 3,046,127, Japanese Pat. application (OPI) No. 63,420/74, and the like.

In order to further improve the photoreduction efficiency of the sensitizers, a hydrogen-yielding compound can be used in combination with these quinone or ketone sensitizers, although sensitizing effects are obtained without the addition of hydrogen-yielding compounds since hydrogen atoms contained in the binder, etc., are capable of reducing the quinone or ketone compounds excited by light. Examples of useful hydrogen-yielding compounds include fatty amines such as triethanolamine, hexamethylenetetramine, etc., acetals such as 1,3-dioxorane, etc., $\beta$-diketones such as acetylacetone, benzoylacetone, dibenzoylmethane, etc., or the like. These hydrogen-yielding compounds can be selected by reference, for example, to Japanese Pat. applications (OPI) Nos. 58,075/73 and 110,781/73.

The photoreductive dyes which can be utilized in the present invention are not specifically limited, and include thiazine dyes such as Methylene Blue, thionine, Methylene Blue D, methylene glycol, etc., acridine dyes such as Acridine Orange, proflavine, acriflavine, etc., xanthene dyes such as eosine, erythrosine, Rose Bengale, fluorescein, Rhodamine B, Phloxine, etc., oxazine dyes such as Nile Blue A, etc., azine dyes such as riboflavin, etc., triphenylmethane dyes such as Malachite Green, Fuchsine, Methyl Violet, Crystal Violet, Ethyl Violet, Victoria Blue, etc., azo dyes such as Naphthol Blue, Alizarine Yellow, etc., anthraquinone dyes such as Alizarine, Alizarine Rubinol, Eriochrome Grey AB, etc., which are chiefly used in combination with a hydrogen-yielding compound, as described, for example, in U.S. Pat. No. 2,734,027; A. H. Adelman et al., *Journal of the American Chemical Society,* 78, p. 3799 (1956); and G. Oster et al., ibid., 79, p. 4836 (1957).

When utilized, the amount of hydrogen-yielding compounds is preferably from about 0.1 to about 10 mols per mol of the sensitizer. In general, however, the hydrogen-yielding compound need not be added since the binder acts as a hydrogen-yielding source itself.

Examples of useful photoreductive metal salts which can be used as a sensitizer in this invention include iron (III) chloride, iron (III) bromide, potassium ferricyanide, cobalt (III) chloride, tin (II) chloride, and the like.

The amount of these sensitizer(s) used is preferably from about 0.01 to about 2 mols, more preferably from 0.1 to 1 mol, per mol of the organo-tellurium compound(s).

The above described sensitizers and hydrogen-yielding compounds can be used either alone or in combination.

As binders used in this invention, there are generally used synthetic, semi-synthetic and naturally occurring polymers having good film forming capability which are resistant to air oxidation, have good light resistance, are capable of remaining unchanged without being decomposed or deteriorated at the temperature of thermal development (about 80° to about 170° C), which have a glass transition temperature lower than the developing temperature, and which are capable of facilitating the migration of image forming substances and the growth of tellurium crystals during development.

Examples of binders which meet these requirements include synthetic polymers such as poly(vinyl chloride), poly(vinylidene chloride), copolymers of vinylidene chloride and acrylonitrile, poly(vinyl acetate), poly(vinyl alcohol), poly(vinyl formal), poly(vinyl butyral), polystyrene, poly(methyl methacrylate), poly(vinyl pyrrolidone), styrenebutadiene copolymers, polyamides, poly(ethylene terephthalate), and the like; semi-synthetic polymers such as acetyl cellulose, ethyl cellulose, cellulose acetate butyrate, and the like; and naturally occurring polymers such as gelatin, natural rubber, and the like. The molecular weight of these binders is preferably from about 1,000,000 to about 500,000. Mixtures of two or more of these binders may also be used. The amount of binder used is preferably from about 0.8 to about 30 parts by weight, more preferably from 1 to 15 parts by weight, per part by weight of the organo-tellurium compound(s). The binder is most preferably utilized in an amount of from 0.5 $g/m^2$ to 50 $g/m^2$ of the support.

The colloidal elements, which are selected from the group consisting of gold, tellurium, germanium, palladium and platinum and are dispersed into light-sensitive materials of the invention, may be used alone or in combination of two or more of them. In this regard, the amount of colloidal tellurium is so low that the presence thereof has no effect on the proportion of the organo-tellurium compound. There may also be used colloidal alloys of two or more of said elements. The colloidal elements can be prepared and dispersed by various methods. For example, the elements may be evaporated onto any of the components to be contained in the light-sensitive materials of the invention, such as a film or powder of a polymeric substances used as a binder, crystallites of organo-tellurium compounds, sensitizers, etc., dissolved into a solvent, and then dispersed in the form of a colloid into a coating solution. In those instances where a deposited layer, for example, evaporated, is not more than about 500 A thick, the metal is deposited in colloidal form on the substrate. Accordingly, when the substrate is dissolved, and added to the light-sensitive component, a light-sensitive coating solution in which colloidal metal is dispersed is obtained. Colloidal particles of the elements may be prepared by reducing a compound of the elements, such as gold chloride, chloroaurate, tellurium halogenides, organo-tellurium compounds, palladium chloride, platinum chloride, etc., in a solution of a reducing agent having an adequate reducing power. Colloidal particles of said elements may also be prepared by electrically reducing the above compounds of the elements. The colloidal particles may be uniformly dispersed into a light-sensitive layer, may be dispersed into a binder layer alone which is adjacent a light-sensitive layer, or may be incorporated into an organo-tellurium containing layer adjacent a layer containing a sensitizing agent alone.

The thus prepared colloidal elements have various shapes and dimensions, depending on the method of the preparation thereof. The diameter of major diameter of the colloid may be measured by the use of an electron microscope. The size of the colloidal elements suited for use in the invention is generally from about 5 A to about 10,000 A, more preferably from 50 A to 500 A. The amount of the colloidal elements dispersed into the light-sensitive materials may be varied over a wide range, depending on the kinds of the elements and the organo-tellurium compound(s) used, but it is generally from about $10^{-6}$ to about $10^{-2}$ g/m$^2$. In practice, this amount may be decided by the trial and error method, that is, when the amount of the colloidal elements is too large, fog is generated, resulting in a darkening of non-image areas, and when it is too small, no significant increase in sensitivity is obtaind. In general, it is preferable to use the colloidal elements at an amount of from 0.3 to 1 time by weight that of the colloidal element which give a fog density of 0.1

The light-sensitive materials of this invention may also contain an anti-fogging agent. As anti-fogging agents, there may be used various oxidizing substances, such as organic compounds, for example, anhydrous tetrachlorophthalate, anhydrous tetrabromophthalate, N-bromosuccinimide, benzoyl peroxide, diacetyl peroxide, t-butyl hydroperoxide, chloranil, bromanil, iodanil, carbon tetrabromide, carbon bromotrichloride, carbon dibromodiiodide, carbon tetraiodide, 1,3,5-trinitrobenzene, m-dinitrobenzene, phthalonitrile, isophthalonitrile, terephthalonitrile, 1,2,4,5-tetracyanobenzene, tetracyanoethylene, tetracyanoquinodimethane, phenyl tribromomethyl sulfone, 9-fluorenone, 2,4,7-trinitro-9-fluorenone, etc., and heavy metal compounds, for example, palladium chloride, palladium-acetylacetone complex, palladium-benzoylacetone complex, palladium-benzoylmethane complex, gold chloride and alkali metal salts thereof, alakli metal salts of platinum chloride, silver chloride, silver bromide, silver iodide, etc.

The amount of the anti-fogging agent used is preferably from about 0.01 to 2.0 mols, more preferably from 0.1 to 1.0 mol, per mol of the organo-tellurium compound(s).

The light-sensitive materials of this invention may also contain a plasticizer, which is used to soften a binder layer, so that cracks due to the brittleness of the binder in the layer are prevented and the development of the material is promoted since the migration of image forming substances, etc., is accelerated upon development.

Examples of useful plasticizers include poly(ethylene glycol), tricresyl phosphate, triphenyl phosphate, butyl phthalylbutyl glycolate, dibutyl phthalate, alkylamines such as stearylamine, laurylamine, behenamine, etc., alkylamides such as behenamide, laurylamide, etc., and the like. The amount of plasticizers used is preferably from about 0.1 to about 3 parts by weight, more preferably from 0.2 to 1.0 part by weight, per part by weight of binder.

The light-sensitive materials of this invention can be prepared by dissolving or dispersing each of the above described components into a solvent, i.e., organo-tellurium compound(s), sensitizer(s), binder(s), colloidal particles of the elements selected from the group consisting of gold, tellurium, germanium, palladium and platinum, and, if necessary or desired, an anti-fogging agent and a plasticizer, and then coating the resulting solution or dispersion onto a support.

As solvents there are preferred those capable of dissolving the above described components other than the colloidal element. For this reason, it is generally preferred to use a solvent having high polarity, but it is also possible to use a solvent having a lower polarity. In order to moderate the drying speed, it is preferred to use a solvent having a boiling point of about 40° to about 200° C. Examples of useful solvents include N,N-dimethylformamide, dimethylsulfoxide, aliphatic ketones such as acetone, methyl ethyl ketone, etc., lower monovalent alcohols such as methanol, ethanol, isopropanol, etc., cyclic ethers such as tetrahydrofuran, 1,4-dioxane, etc., esters and ethers such as ethyl acetate, ethylene glycol monomethyl ester, etc., halogenated hydrocarbons such as chloroform, methylene chloride, 1,2-dichloroethane, carbon tetrachloride, trichloroethylene, etc., and aromatic hydrocarbons such as benzene, toluene, xylene, etc., and halogenated derivatives thereof. The ratio of the solvent to the binder used can be varied over a wide range, depending on the molecular weight of the polymer used as the binder and the desired thickness of the light-sensitive layer. In general, the amount of a solvent used is preferably from about 2 to about 20 parts by weight, more preferably from 5 to 15 parts by weight, per part by weight of binder.

As supports, there may be used various kinds of sheets, films, plates, etc., having a good adhesiveness to the light-sensitive layer of the invention. The selection of a suitable support can be made depending on the application of the light-sensitive material of the invention. Examples of supports include films of synthetic and semi-synthetic polymers such as polyethylene terephthalate, polyimides, nylon, triacetyl cellulose, etc., opaque polymeric materials such as paper, synthetic papers, leather, synthetic leather, cloth, wooden plates, etc., and inorganic materials such as metal plates, glass plates, etc. These supports may be provide with an antihalation layer, if desired.

The coating of the light-sensitive layer onto a support can be carried out by various methods known in the art, including rod coating, roller coating, curtain coating and dip coating. The amount of coating solution to be coated may be varied depending on the desired thickness of the light-sensitive layer of the invention, which, in general, is preferably from about 0.5 to about 100 $\mu$, more preferably from 1 to 50 $\mu$, after drying. Drying is preferably effected at a temperature of from about 30° to about 100° C, more preferably from 40° C to 80° C. Drying is conveniently performed in a period of from about 10 minutes to about 3 hours. It should be noted in this regard that the light-sensitive layer of this invention is the only mandatory layer which is required, though other layers can be present, if desired.

There will hereinafter be explained the process of forming images using the light-sensitive materials of this invention.

The light-sensitive material is exposed through a desired original to electromagnetic waves, such as visible light and UV light. As light sources for the exposure, there may be used, for example, a xenon lamp, a mercury lamp, a tungsten lamp, a carbon arc, etc., as well as X-rays and electron beams. The selection of a suitable light source is chiefly dependent on the spectrally sensitizing property of the sensitizer used. The time required for the exposure is, in the case where the exposure is effected using a 1 kw xenon lamp at a distance of 30 cm, preferably from 0.01 sec. to 60 sec., more preferably from 0.5 sec. to 30 sec.

The exposed light-sensitive material, in which a latent image is formed, generally shows no visible image. The light-sensitive material is then heated to develop the latent image. The heating of the material may be effected, for example, by closely contacting it with a hot plate heated uniformly at a constant temperature, by passing it through heated rollers, by exposing it to thermal rays from, for example, an IR lamp or a heater, or by passing it through a heated liquid. A visible image may also be obtained by effecting the exposure at elevated temperature. Typically, if exposure is at room temperature heating is at about 80° to about 200° C, whereby a visible image is formed, while, on the other hand, if exposure is conducted at about 100° to about 150° C, a visible image is directly formed. The temperature of the thermal development is generally from about 80° C to about 200° C, preferably from 100° C to 150° C, and the heating time is generally from about 1 sec. to about 200 sec., preferably from 10 sec. to 100 sec.

By the thermal development described above, there can be obtained a black, dark brown, or bluish black image consisting of crystallites of tellurium. Thus thus obtained image is generally stable for a long period of time, and no fixing is required since the background of the image is not darkened even if it is exposed to room light, so long as it is not heated to an elevated temperature, e.g., higher than 50° C. However, in the case where the background of the image is apt to be darkened by room light or light used for the observation thereof, the light-sensitive element may be fixed by immersing it into an appropriate solvent in order to extract the sensitizer(s) and/or organotellurium compound(s) remaining therein. In general, any solvent which can dissolve at least the organo-tellurium compound or the sensitizer and can swell the binder can be utilized for fixing. Suitable examples of solvents used for fixing purposes are those solvents earlier described as utilized for forming the coating composition used to form the light-sensitive materials of the present invention. Fixing is conveniently performed at atmospheric pressure in about 5 to about 10 seconds at a temperature of about 10° to about 50° C.

The light-sensitive materials of the invention can be used for a variety of image recording applications, for example, as an ordinary duplication material, as a microfilm, as a slide, or the like.

The light-sensitive materials of the invention have remarkably improved sensitivity, compared with those of prior art light-sensitive materials comprising an organo-tellurium compound, a sensitizer and a binder, but no colloidal particles according to the invention.

The present invention is further illustrated by the following Examples. Unless otherwise noted, all parts are by weight. In all of the following Example, unless otherwise indicated, any colloidal particles utilized had a size of 50 to 500 A (average diameter).

EXAMPLE 1

Into 10 parts of N,N-dimethylformamide was dissolved 1 part of polyvinyl butyral, and the resulting solution coated by a rod coater onto a polyethylene terephthalate film having a thickness of 50 $\mu$, and dried to give a polyvinyl butyral layer having a dry thickness of 10 $\mu$. Onto the polyvinyl butyral layer was independently evaporated gold, tellurium and germanium by means of the vacuum evaporation method.

The vacuum deposition conditions used were conventional. Gold was vacuum evaporated using an EBH-6 vacuum evaporation device produced by Nippon Vacuum Co., Ltd. The surface of the film to be coated was merely placed facing a boat (or vessel) made of a high temperature resistant material (molybdenum) and the vacuum evaporation source placed therein (powdered gold). The system was then evacuated to $4 \times 10^{-5}$ to $8 \times 10^{-5}$ Torr, the vacuum evaporation source heated and, after 1 to 2 minutes of current passage, the shutter of the boat opened to permit the vacuum evaporation, the shutter being closed when the layer vacuum evaporated reached the desired thickness (measured by a DTM-200 measurement device, produced by Sloan Co., Ltd.). Tellurium and germanium were deposited in a substantially identical manner.

The thicknesses of evaporated films were determined by a film thickness gauge attached to the evaporator. The evaporated films of gold, tellurium and germanium had mean thicknesses of 20 A, 40 A and 45 A, respectively. The evaporated films were observed by an electron microscope. The gold was evaporated thereon in the form of colloidal particles having an almost spherical shape, and the tellurium and the germanium in the form of colloidal particles having no definite shape.

In the following Examples, a definite area of the thus prepared sheets consisting of a polyethylene terephthalate base and a polyvinyl butyral layer having colloidal particles evaporated thereon (the sheet is called an evaporated sheet) was cut, and the cut sheet was immersed into a coating solution or dispersion for a light-sensitive material in order to dissolve the polyvinyl butyral layer so that the colloidal particles could be dispersed into the solution or dispersion. The base was removed after the polyvinyl butyral layer had been dissolved off.

EXAMPLE 2

A colloidal gold containing dispersion was prepared from the following components:

| | |
|---|---|
| Tetradecylamine tellurium chloride complex | 20 mg |
| 9,10-phenanthraquinone | 20 mg |
| Polyvinyl butyral | 250 mg |
| The gold evaporated sheet prepared in Example 1 | 2 $cm^2$ |
| N,N-dimethylformamide | 3 ml |

The resulting dispersion was coated by a rod coater onto a polyethylene terephthalate film having a thickness of 50 $\mu$, and dried at 60° for 1 hour to prepare a light-sensitive material provided with a light-sensitive layer having a thickness of 10 $\mu$. The light-sensitive material was exposed for 60 sec. to a 1 kw xenon lamp at a distance of 30 cm through an optical wedge having differences of optical density of 0.2 which was prepared from a conventional silver halide light-sensitive material. No visible change was observed at this stage. The exposed light-sensitive material was then closely contacted for 100 sec. with a hot plate uniformly heated to 150° C. There was obtained a bluish black negative (against the original) image having 18 steps.

EXAMPLE 3

(comparative example)

Example 2 was repeated, except that the gold evaporated sheet was not used. Only 13 steps could be observed in the image. It is apparent that the sensitivity of the light-sensitive material in Example 2 is increased to a factor of 10 by means of the incorporation of the colloidal particles.

EXAMPLE 4

A colloidal tellurium containing dispersion was prepared from the following components:

| | |
|---|---|
| Stearylamine-tellurium tetrachloride complex | 25 mg |
| 9,10-phenanthraquinone | 20 mg |
| Polyvinyl butyral | 250 mg |
| The tellurium evaporated sheet prepared in Example 1 | 4 $cm^2$ |
| Anhydrous tetrachlorophthalate (anti-foggant) | 5 mg |
| N,N-dimethylformamide | 3 ml |

A light-sensitive material was prepared as in Example 2 using the thus prepared dispersion, and it was processed as in Example 2, except that the thermal development was carried out for 70 sec. at 140° C. There was obtained an image having 17 steps.

The above procedure was repeated, except that the tellurium evaporated sheet was not used. There was obtained an image having only 12 steps.

EXAMPLE 5

A colloidal germanium containing dispersion was prepared from the following components:

| | |
|---|---|
| Tellurium bisacetophenone dichloride ($(C_6H_5COCH_2)_2TeCl_2$) | 50 ml |
| 2-methylanthraquinone | 25 ml |
| Polyvinyl formal | 250 mg |
| The germanium evaporated sheet prepared in Example 1 | 4 $cm^2$ |
| Triphenyl phosphate (plasticizer) | 5 mg |
| Tetrahydrofuran | 3 ml |

A light-sensitive material was prepared as in Example 2 using the thus prepared dispersion, and it was processed in the same manner as in Example 2, except that the thermal development was effected for 30 sec. There was obtained a black negative (against the original) image having 13 steps.

The above procedure was repeated, except that the germanium evaporated sheet was not used. There was obtained an image having only 10 steps.

EXAMPLE 6

A colloidal gold containing dispersion was prepared from the following components:

| | |
|---|---|
| p-Trifluoromethylaniline-tellurium tetrachloride complex | 50 mg |
| Benzophenone | 50 mg |
| Polyvinyl chloride | 250 mg |
| The gold evaporated sheet prepared | 3 $cm^2$ |

-continued

| | |
|---|---|
| in Example 1 | |
| 1,4-dioxane | 2.5 ml |

A light-sensitive material was prepared as in Example 2 using the thus prepared dispersion, and it was processed in the same manner as in Example 2, except that the thermal development was effected for 30 sec. at 130° C. There was obtained a dark brown negative (against the original) image having 13 steps.

The above procedure was repeated, except that the gold evaporated sheet was not used. There was obtained an image having 11 steps.

EXAMPLE 7

A light-sensitive material was prepared as in Example 2. It was closely contacted under reduced pressure with an original for a resolving power test, exposed through the original for 3 sec. to a 2 kw high pressure mercury lamp at a distance of 55 cm, and then thermally developed by contacting it for 100 sec. with a hot plate heated to 150° C. There was obtained an image having a resolving power of 300 lines/mm.

EXAMPLE 8

A light-sensitive material prepared as in Example 2 was closely contacted with a negative original of a silver halide black-and-white film having an image taken by a camera, exposed for 3 sec. to a 1 kw xenon lamp at a distance of 30 cm, and then thermally developed as in Example 2. There was obtained a bluish black positive image of high quality. The density of the image was not reduced and the background area of the image was not colored even after it had been exposed to outdoor light for 2 weeks.

While the invention has been described in detail and with reference to specific embodiments thereof, it will be apparent to one skilled in the art that various changes and modifications can be made therein without departing from the spirit and scope thereof.

What is claimed is:

1. A light-sensitive material for image-forming which comprises a support having coated thereon at least one layer comprising an organo-tellurium compound, as the image-forming material; a sensitizer for said organo-tellurium compound selected from the group consisting of a quinone compound, a ketone compound, a photoconductive dye and a photoreductive metal salt; a polymeric binder; and colloidal particles of an element selected from the group consisting of gold, tellurium, germanium, palladium, platinum or mixtures or alloys thereof.

2. The light-sensitive material of claim 1, wherein said organo-tellurium compound is present in an amount of from about 0.01 $g/m^2$, expressed as elemental tellurium, per square meter of the support.

3. The light-sensitive material of claim 2, wherein said sensitizer is present in an amount of from about 0.01 to 2 mols per mol of the organo-tellurium compound.

4. The light-sensitive material as claimed in claim 3, wherein said binder is present in an amount of from about 0.8 to about 30 weight parts per weight part of the organo-tellurium compound.

5. The light-sensitive material as claimed in claim 4, wherein said colloidal particles are present in an amount of from about $10^{-6}$ $g/m^2$ to about $10^{-2}$ $g/m^2$ of the support.

6. The light-sensitive material as claimed in claim 5, wherein said binder is coated in an amount of from about 0.5 g/m² to about 50 g/m² of the support.

7. The light-sensitive material of claim 6, wherein said colloidal particles have a size of from about 50 to about 500 A (average diameter).

8. The light-sensitive material of claim 1, wherein said colloidal particles are gold.

9. The light-sensitive material of claim 1, wherein said colloidal particles are tellurium.

10. The light-sensitive material of claim 1, wherein said colloidal particles are germanium.

11. The light-sensitive material of claim 1, wherein said colloidal particles are palladium.

12. The light-sensitive material of claim 1, wherein said colloidal particles are platinum.

13. The light-sensitive material of claim 1, wherein the organic Te compound is a compound selected from compounds represented by the following formula: Y-$TeX_2$-Y' wherein X represents a chlorine, bromine or iodine atom and the two halogen atoms can be the same or different from each other, and Y and Y' represent groups selected from the following group (A) to group (C) and Y and Y' are the same or different from each other:

A. Y and Y' are an Ar—CO—$CH_2$—group, wherein Ar is a phenyl, naphthyl, anthryl, furyl, thienyl, xanthenyl, benzofuranyl or a benzoquinonyl group or a substituted group thereof;

B. Y and Y' are an R—$COCH_2$— group wherein R designates an alkyl group, an alkenyl group, or a substituted group thereof;

C. Y and Y' are Ar as defined in (A) above or R as defined in (B) above;

compounds represented by the general formula:

Z-$TeX_3$, wherein X designates a chlorine, bromine or iodine atom and the three halogen atoms are the same or different from each other, and Z has the same meaning as Y or Y';

and complexes formed by tellurium tetrachloride and an organic base represented by the following general formula:

DN·$TeX_4$ wherein X represents a chlorine, bromine or iodine atom and the four halogen atoms are the same or are two or three different halogen atoms, D designates an organic base, selected from the group consisting of an aliphatic amine compound, an aralkylamine, an aromatic amine compound and a nitrogen atom containing heterocyclic compound and n is an integer of 1 to 6.

14. The light-sensitive material of claim 13, wherein when Ar is substituted, the substituent is selected from the group consisting of (i) an alkyl group having 1 to 20 carbon atoms (ii) a substituted alkyl group having 1 to 20 carbon atoms where the substituent includes a hydroxyl group, an alkoxy group containing 1 to 5 carbon atoms, a halogen atom, a cyano atom, an acetyl group, a phenyl group, a naphthyl group, a phenoxy group, a phenyl group substituted by a halogen atom, a naphthyl group substituted by a halogen atom, and a phenoxy group substituted by a halogen atom, (iii) a halogen atom, (iv) a hydroxyl group, (v) an alkoxy group having 1 to 20 carbon atoms, (vi) an alkoxy group substituted by a halogen atom and having 1 to 20 carbon atoms, (vii) an acyl group having 1 to 20 carbon atoms, (viii) a benzoyl group, (ix) a substituted benzoyl group where substituents include an alkyl group containing 1 to 5 carbon atoms, a haloalkyl group having 1 to 5 carbon atoms, and a halogen atom; (x) a nitro group, (xi) a cyano group, (xii) a phenyl group, (xiii) a phenoxy group, (xiv) a substituted phenyl or phenoxy group where substituents include an alkyl group having 1 to 10 carbon atoms, a haloalkyl group having 1 to 5 carbon atoms and an alkoxy group having 1 to 10 carbon atoms, (xv) an alkenyl group containing 1 to 20 carbon atoms, (xvi) a substituted alkenyl group containing 1 to 20 carbon atoms where substituents include a halogen atom, a hydroxy group, an alkoxy group containing 1 to 5 carbon atoms, a cyano group, an acetyl group, a phenyl group, a substituted phenyl group where substituents include an alkyl group having 1 to 5 carbon atoms, a hydroxy group, an alkoxy group having 1 to 5 carbon atoms or a halogen atom, (xvii) a furyl group, and (xviii) a xanthenyl group.

15. The light-sensitive material of claim 13, when R, if a substituted group thereof, comprises a substituent selected from the group consisting of (1) a halogen atom; (2) a hydroxy group; (3) an alkoxy group having 1 to 10 carbon atoms, (4) an alkoxy group substituted with (i) a halogen atom and having 1 to 10 carbon atoms; (5) an acyl group having 1 to 15 carbon atoms, (6) a cyano group; (7) an aromatic ring containing group selected from the group consisting of a phenyl group, naphthyl group, anthryl group, phenoxy group, and a benzoyl group, (8) a substituted group of these aromatic rings where substituents include an (i) allyl group containing 1 to 10 carbon atoms and (ii) such an alkyl group substituted with a halogen atom or with an alkoxy group having 1 to 5 carbon atoms, (iii) a halogen atom; (iv) a hydroxyl group; (v) an alkoxy group containing 1 to 10 carbon atoms; (vi) an alkoxy group having 1 to 10 carbon atoms and substituted with a halogen atom; (vii) an acyl group having 1 to 5 carbon atoms; (vii) a benzoyl group; (viii) a phenyl group; (ix) a phenoxy group and (x) a substituted benzoyl, phenyl or phenoxy group wherein substituents include an alkyl group having 1 to 10 carbon atoms, a haloalkyl group having 1 to 10 carbon atoms or a halogen atom.

16. The light-sensitive material of claim 13, wherein D is selected from the group consisting of an (i) aliphatic amine having 1 to 25 carbon atoms, (ii) an aralkyl amine having 7 to 35 carbon atoms wherein the aryl moiety is phenyl, naphthyl or anthryl, (iii) an aromatic amine having 6 to 35 carbon atom wherein the aromatic ring is phenyl, naphthyl or anthryl (iv) N-containing heterocyclic compounds having 5 or 6 members selected from the group consisting of those having a pyridine ring, a pyridazine ring, a pyrimidine ring, a pyrazine ring, a 1,3,5-triazine ring, a pyrrole ring, a quinoline ring, an indole ring, a carbazole ring, (v) a phenyl or naphthyl diazonium salt.

* * * * *